US009413071B2

(12) United States Patent
Iellici

(10) Patent No.: US 9,413,071 B2
(45) Date of Patent: Aug. 9, 2016

(54) PLANAR RADIO-ANTENNA MODULE

(75) Inventor: Devis Iellici, Stow-cum-Quy (GB)

(73) Assignee: Microsoft Technology Licensing, LLC, Redmond, WA (US)

( * ) Notice: Subject to any disclaimer, the term of this patent is extended or adjusted under 35 U.S.C. 154(b) by 839 days.

(21) Appl. No.: 12/937,020

(22) PCT Filed: Apr. 1, 2009

(86) PCT No.: PCT/GB2009/050319
§ 371 (c)(1),
(2), (4) Date: Oct. 8, 2010

(87) PCT Pub. No.: WO2009/125214
PCT Pub. Date: Oct. 15, 2009

(65) Prior Publication Data

US 2011/0037661 A1 Feb. 17, 2011

(30) Foreign Application Priority Data

Apr. 8, 2008 (GB) ..... 0806335.6

(51) Int. Cl.

| | |
|---|---|
| ***H01Q 1/38*** | (2006.01) |
| ***H01Q 9/24*** | (2006.01) |
| ***H01Q 9/04*** | (2006.01) |
| ***H01Q 9/42*** | (2006.01) |

(52) U.S. Cl.
CPC . *H01Q 9/24* (2013.01); *H01Q 1/38* (2013.01); *H01Q 9/0421* (2013.01); *H01Q 9/42* (2013.01)

(58) Field of Classification Search
CPC ..... H01Q 1/243; H01Q 1/38; H01Q 9/0407
USPC ..... 343/700 MS, 702
See application file for complete search history.

(56) References Cited

U.S. PATENT DOCUMENTS

| | | | | |
|---|---|---|---|---|
| 3,656,167 | A * | 4/1972 | Lea | H03H 7/383 343/793 |
| 6,218,997 | B1 | 4/2001 | Lindenmeier et al. | |
| 6,252,553 | B1 | 6/2001 | Solomon | |

(Continued)

FOREIGN PATENT DOCUMENTS

| | | |
|---|---|---|
| CN | 1419720 | 5/2003 |
| EP | 1 011 167 | 6/2000 |

(Continued)

OTHER PUBLICATIONS

International Search Report, mailed Jul. 14, 2009 for International Application No. PCT/GB2009/050319.

(Continued)

*Primary Examiner* — Dameon E Levi
*Assistant Examiner* — Collin Dawkins
(74) *Attorney, Agent, or Firm* — Qudus Olaniran; Judy Yee; Micky Minhas

(57) ABSTRACT

There is disclosed a radio-antenna module formed on a daughterboard comprising a substrate, a radio circuit and a monopole antenna. The radio circuit is fed between two points on the monopole antenna having a predetermined relative impedance difference and neither of which points is at zero impedance (ground). The module operates well in a vertical orientation and can discriminate between right and left hand circular polarisation, making it ideal for personal navigation device and other global positioning system applications.

26 Claims, 2 Drawing Sheets

(56) References Cited

U.S. PATENT DOCUMENTS

| | | | | |
|---|---|---|---|---|
| 6,608,594 | B1 | 8/2003 | Kane et al. | |
| 7,123,209 | B1 | 10/2006 | Desclos et al. | |
| 2002/0105474 | A1* | 8/2002 | Kitamura et al. | 343/850 |
| 2002/0135525 | A1* | 9/2002 | Ikegaya | G06F 1/1616 343/767 |
| 2003/0146874 | A1 | 8/2003 | Kane et al. | |
| 2003/0169209 | A1 | 9/2003 | Ohara et al. | |
| 2005/0052334 | A1* | 3/2005 | Ogino | H01Q 1/1271 343/866 |
| 2005/0088346 | A1* | 4/2005 | Hwang | H01Q 1/244 343/702 |
| 2005/0285798 | A1* | 12/2005 | van Wonterghem | H01Q 1/244 343/702 |
| 2006/0092081 | A1* | 5/2006 | Kanazawa | 343/702 |
| 2006/0176233 | A1 | 8/2006 | Tang et al. | |
| 2007/0069956 | A1 | 3/2007 | Ozkar | |
| 2007/0132649 | A1* | 6/2007 | Vincent | 343/749 |
| 2007/0188391 | A1* | 8/2007 | Tu | G06F 1/1616 343/702 |
| 2007/0285335 | A1* | 12/2007 | Bungo et al. | 343/895 |
| 2008/0180334 | A1* | 7/2008 | Vincent | H01Q 9/36 343/745 |

FOREIGN PATENT DOCUMENTS

| | | | |
|---|---|---|---|
| EP | 1 398 847 | | 3/2004 |
| EP | 1 898 488 | | 3/2008 |
| GB | 0640152 | | 7/1950 |
| GB | 2416246 | | 1/2006 |
| GB | 2450786 | | 1/2009 |
| JP | 2002237711 | A | 8/2002 |
| JP | 2006186880 | | 7/2006 |
| KR | 10-20040062652 | A | 7/2004 |
| WO | 02060005 | A1 | 8/2002 |
| WO | WO2007/040638 | | 4/2007 |

OTHER PUBLICATIONS

Examination Report, issued Feb. 15, 2010, for GB Application No. GB0905609.4.

Search Report, issued Jul. 16, 2008, for GB Application No. GB0806335.6.

Search Report, issued Jul. 17, 2009, for GB Application No. GB0905609.4.

"Office Action Issued in Korean Patent Application No. 10-2010-7024804", Mailed Date: Feb. 23, 2015, 6 Pages. (w/o English Translation).

* cited by examiner

PLANAR RADIO-ANTENNA MODULE

CROSS-REFERNCE TO RELATED APPLICATIONS

This application is a National Phase Application of PCT International Application No. PCT/GB2009/050319, International Filling Date 1 Apr. 2009, claiming priority of British Patent Application, 0806335.6, filed 8 Apr. 2008, both of which are incorporated by reference herein.

FIELD OF THE INVENTION

Embodiments of the present invention relate to a radio-antenna module with a radiation pattern that is good for personal navigation devices (PNDs) and automotive Global Positioning System (GPS) receiver applications. The device comprises an antenna, interconnecting circuitry and an integrated radio component. In particular, but not exclusively, embodiments of the present invention provide a substantially planar GPS radio antenna module.

BACKGROUND

Automotive GPS receivers for navigation are characterised by a large vertical LCD display and tend to be relatively thin in depth. The most commonly used antenna element is the rectangular ceramic patch antenna. These work well, provided they are large enough, and they are designed for efficient reception of right hand circularly polarised (RHCP) signals from the GPS satellite constellation. Ceramic patch antennas also need to be deployed substantially horizontally to work well. This means that a typical patch 25×25 mm or 17×17 mm square cannot be incorporated directly into the housing unless the housing is made very deep. An alternative solution is to use a hinged external patch antenna that may be flipped up into the horizontal position, as shown in FIG. 1*a* of the drawings. This is both mechanically awkward and expensive. Ceramic patches smaller than 17×17 mm exist but they perform less well and do not have such a good response to RHCP signals.

It is known from US 2003/0146874 to provide an antenna having a radiating structure in the form of a circular arc. The method of operation relies on the presence of a parasitic conductor. The driven element has a connection point close to ground which is referred to as the 'neutral electrode', which is stated to allow all currents of a quarter-wavelength to be distributed over the radiating element, and thus to have the effect of maximizing radiant efficiency (gain characteristics). If the neutral electrode is not provided, the currents of a quarter-wavelength are distributed to the radiating element and first connecting electrode, reducing current components in the radiating element and lowering the radiant efficiency (gain characteristics) to some extent.

There is no discussion as how the position of the 'neutral electrode' is to be determined—it simply seems to be at the upper end of the 'first connecting electrode'. In particular, there is no explicit disclosure as to advantages obtained by feeding between two non-grounded points.

SUMMARY OF THE INVENTION

According to the present invention, there is provided a daughterboard comprising a substrate, a radio circuit and a monopole antenna, wherein the radio circuit is fed between two points on the monopole antenna having a predetermined relative impedance difference and neither of which points is at zero impedance (ground).

In use, one end of the monopole antenna will be connected to ground, typically by way of a connection to a groundplane on a separate motherboard.

The one end of the monopole antenna may be provided with a conductive connector having a predetermined length so as to provide a connection to ground at one end of the conductive connector while maintaining non-zero impedance at the other end of the conductive connector which is connected to the first point of the monopole antenna.

Where the one end of the monopole antenna actually connects to ground (whether directly or by way of a connector arrangement) will be at an impedance of substantially zero, while the other end (the radiating tip) will have an impedance approaching infinity (because the voltage is very high and the current is very low). The radio circuit is fed between these two points on the monopole, the points having a predetermined relative impedance difference (for most applications, this will be 50 ohms, but other differences may be useful), with neither of the feed points being at ground. In most applications, neither of feed points will be at or near the radiating tip, because the impedance will generally increase rapidly, tending to infinity, towards the tip at the end of the monopole antenna, which will make selection of two points with a predetermined relative impedance difference difficult to select within preferred manufacturing tolerances.

It is conventional, when using an unbalanced (differential) radio circuit, for one side to be grounded, and the other side to be connected to an antenna. The present invention utilises a very different arrangement in which neither side of the radio circuit is directly grounded, and the feed is between two sections of the antenna.

In preferred embodiments, the radio circuit actually comprises part of the monopole antenna, since it is fed between two points on the monopole antenna. In other words, the radio circuitry in preferred embodiments is not just on the antenna, but actually forms part of the antenna. This can extend to all of the relevant circuitry on the daughterboard, i.e. the daughterboard as a whole may form the antenna.

The monopole antenna may be formed on one side of the substrate, and the radio circuit may be located on an opposed side of the substrate.

The daughterboard may further comprise an RF screened enclosure or housing in which the radio circuit is contained. The RF screened enclosure or housing may be made of an electrically conductive material and may form part of the monopole antenna.

The radio circuit may be provided with a connection that passes through the RF screened enclosure and contacts the second point on the monopole antenna.

The monopole antenna may comprise at least first and second connected portions, and optionally third or further connected portions. The portions may be configured as etched or printed or otherwise-formed conductive tracks or patches on the substrate, generally all on the same side of the substrate, although in some embodiments at least one portion may be on an opposed side of the substrate and connected with another portion by way of a conductive via or the like.

In a particularly preferred embodiment, the first and second portions may each comprise a generally planar conductive area formed on the substrate, the areas being arranged so as to define a slot therebetween. Although the first and second portions are still galvanically connected to each other, the provision of a slot or gap can provide additional scope for tuning or otherwise adjusting characteristics of the antenna by adjusting the width and/or length of the slot. In typical embodiments, the slot may be substantially parallel-sided. The first point on the monopole antenna from which the radio circuit is fed may be located on the first portion, and the second point may be located on the second portion, preferably on the other side of the slot from the first portion.

The daughterboard of the present invention, which includes the monopole antenna, the radio circuit and optional auxiliary components such as a baseband processor and GPS components, may then be mounted substantially parallel to, for example elevated above, a main motherboard PCB having a full groundplane to which one end of the monopole antenna can be attached. Advantageously, the daughterboard is spaced from the motherboard at a distance of 1 to 10 mm, preferably substantially 4.5 mm.

The novel feeding arrangement on the daughterboard, combined with image currents generated in the groundplane on the motherboard, give an enhancement of RHCP signals over left hand circularly polarised (LHCP) signals, typically in a ratio of around 60:40.

It will be understood that while the present invention is disclosed primarily in the context of PNDs and the GPS band, it may also find utility in other applications, especially those where circular polarisation is important. On the other hand, since the circular polarisation is not strong, embodiments of the invention may also be used effectively for linearly polarised applications such as Bluetooth® and WLAN.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

BRIEF DESCRIPTION OF THE DRAWINGS

For a better understanding of the present invention and to show how it may be carried into effect, reference shall now be made to the accompanying drawings, in which:

FIG. 1(*b*) shows a PND including an embodiment of the present invention;

FIG. 2(*b*) shows a prior art elevated feed monopole;

FIG. 3(*b*) shows an electrically and topologically equivalent electrical layout to the feeding arrangement of FIG. 3(*a*);

DETAILED DESCRIPTION

Figure 1A:
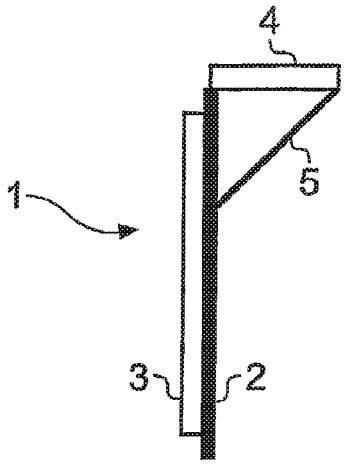
FIG. 1(a) (RELATED ART)
FIG. 1(*a*) shows a prior art PND in profile.
Figure 1B:
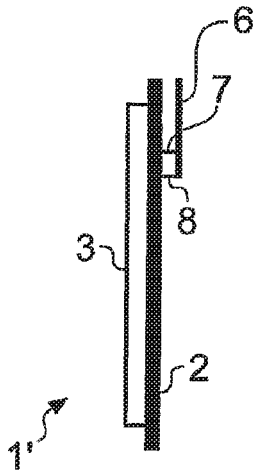

FIG. 1(*a*) shows, in side profile, a prior art PND or GPS receiver 1 essentially comprising a PCB 2 and an LCD display 3 mounted on the PCB 2. A ceramic patch antenna 4 is mounted at an upper edge of the PCB 2 and provided with a hinge mechanism 5. The hinge mechanism 5 allows the antenna 4 to be folded parallel to the PCB 2 when not in use. The antenna 4 needs to be in a generally horizontal orientation during use so as to receive GPS signals from the GPS constellation and to make use of circular polarisation.

It is to be understood that the PND/GPS receiver 1 generally includes a housing (not shown). If a horizontal ceramic patch antenna 4 is fixed within the housing, then the housing needs to have a very deep profile in order to accommodate the antenna 4. It is generally, therefore, preferred to have a relatively slim housing and the hinge mechanism 5 as shown in FIG. 1(*a*). The hinge mechanism 5 is, however, an additional expense and is susceptible to damage. Moreover, it adds to user inconvenience.

FIG. 1(*b*) shows, in side profile, a PND/GPS receiver 1' designed in accordance with an embodiment of the present invention, comprising a PCB 2 and an LCD display 3. The PCB 2 can be defined as a motherboard having a full groundplane (not shown). A daughterboard 6 of an embodiment of the present invention, comprising a radio circuit and a grounded monopole antenna, is mounted parallel to the motherboard and connected thereto by a pair of feeds 7, 8. It can be seen that the overall profile of the device 1' is significantly thinner than that of the prior art device 1 of FIG. 1(*a*). Moreover, no moving hinge mechanism is required. A preferred embodiment of the present invention is designed as a planar radio-antenna module disposed substantially parallel to the main PCB 2 and spaced quite closely thereto, typically with a gap of around 4.5 mm between the motherboard and the daughterboard 6.

The performance of the antenna part of the module of some embodiments shown in FIG. 1(*b*) is similar to that of a 17×17 mm ceramic patch antenna based system and shown in FIG. 1(*a*). However, a patch antenna 4 would need to be mounted horizontally at the top of a PND or automotive GPS receiver 1 and this gives the device a deep profile. Moreover, awkward and expensive frames are used to support the patches. With respect to the patch 4, embodiments of the present invention have the advantage of being low profile allowing the design of a thin PND without compromising performance. The device can be easily tuned and configured for new applications and makes use of low cost materials such as FR4 substrate material for the printed circuit board (PCB). Embodiments of the present invention also incorporate the complete radio plus baseband processing system and preferred embodiments require only a 3.6 volt power supply to provide positional information.

Figure 2A:
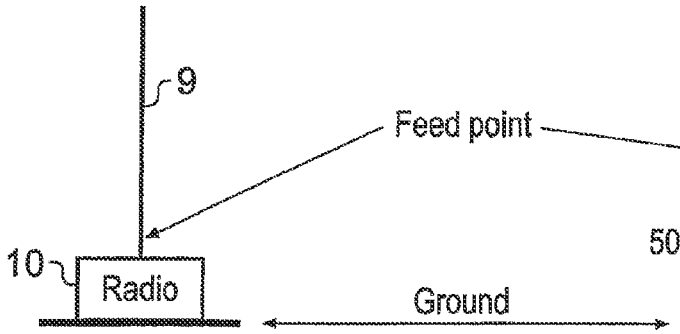
FIG. 2(a) (RELATED ART)
FIG. 2(*a*) shows a prior art conventionally fed monopole.
Figure 2B:
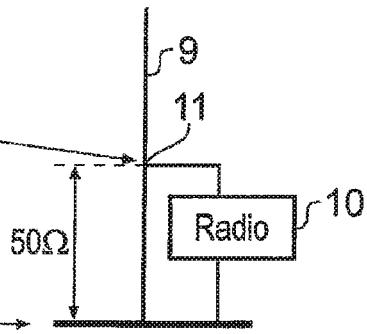
FIG. 2(b) (RELATED ART)
Figure 3A:
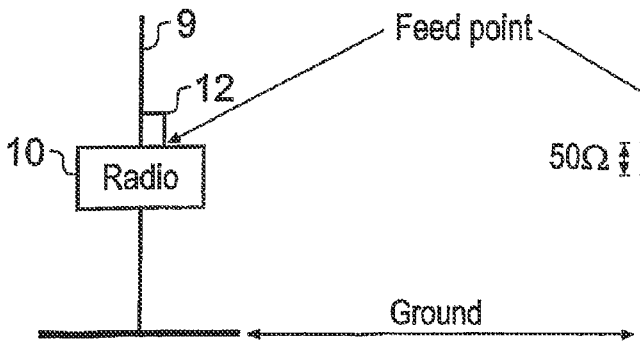
FIG. 3(*a*) illustrates a feeding arrangement used in embodiments of the present invention.
Figure 3B:
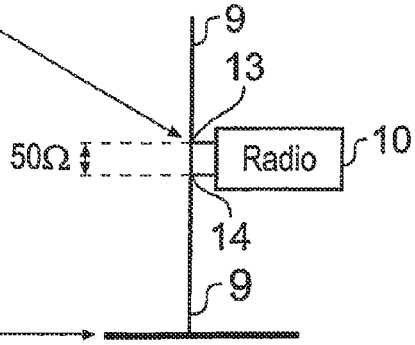

FIG. 2(*a*) shows a conventional prior art arrangement for feeding a monopole 9 from a radio circuit 10 at the base. A better impedance match may be obtained by grounding the base of the monopole 9 and feeding it at the 50 ohm point 11 part of the way up the structure as shown in FIG. 2(*b*); this is also prior art and is sometimes known as a shunt fed monopole or an elevated feed monopole. An embodiment of the present invention is shown in FIG. 3(*a*) where the radio circuit 10 actually forms part of the vertical structure of the monopole 9 and the feed 12 is disposed on the upper part. Although this is the physical arrangement, the invention may be more easily understood if it is re-drawn as in FIG. 3(*b*). Here two points 50 ohms apart 13, 14 are chosen part of the way up the structure and the radio circuit 10 is connected between them. It must be appreciated that the impedance of the monopole 9 at the base is zero because it is grounded and the impedance of the monopole 9 at the radiating tip approaches infinity because the voltage is very high and the current is very low.

Between the base and the tip the impedance rises steadily and two points 13, 14 with a relative impedance difference of 50 ohms may be chosen instead the conventional teaching of feeding between ground and the absolute 50 ohm point 11.

Figures 4A, 4B:
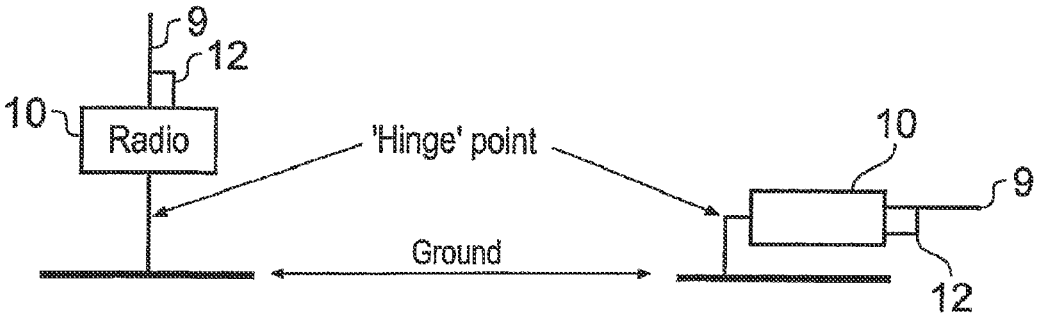
FIGS. 4(*a*) and 4(*b*) show embodiments of the present invention in schematic form.

The next step to create a low profile planar structure is to 'hinge' the radio-antenna module below the radio as in the steps shown in FIGS. 4(*a*) and 4(*b*), thereby to allow it to lie parallel and close to the motherboard.

Embodiments of the present invention provide an extremely efficient linear antenna and have reasonably good RHCP performance.

By optimising the antenna shape and the location on the PCB it is possible to generate a radiation pattern optimal for PND and automotive GPS applications.

Embodiments of the present invention also enable a very slim PND or other device to be built—the module need be only 4.5 mm above the PCB. When used in this way (and when optimally positioned on the motherboard), embodiments of the present invention can produce a vertical facing hemispherical radiation pattern similar to that produced by a horizontal patch antenna, even though the device is disposed in a vertical plane parallel to a vertical motherboard.

The substrate may be FR4, so there is no need for expensive, low-loss material.

The reverse side of the main motherboard may be fully populated with components.

The module may incorporate sufficient additional filtering for it to be used in mobile phones.

Performance can be made close to that of a 17×17 mm ceramic patch. With respect to the patch it has the big advantage of being low profile allowing the design of thin PND without compromising performances.

Figure 5:
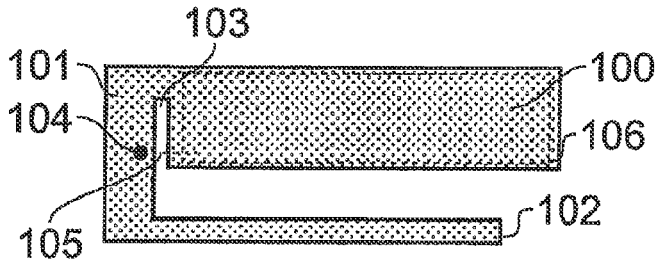
FIGS. 5 and 6 show an embodiment with a currently preferred radiating element configuration.
Figure 6:
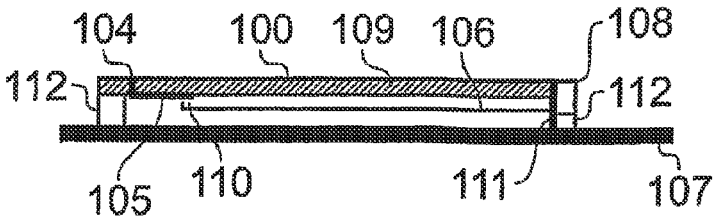

FIGS. 5 and 6 show an exemplary preferred embodiment with details of a preferred configuration for the monopole antenna radiating element.

The daughterboard module comprises a multi-layer printed circuit board 109 with a copper layer on both its planar surfaces. The dielectric material of the printed circuit board 109 may be of any typical material used for radio frequency circuits or a combination of materials in different layers. On the upper side of the printed circuit board 109 is formed an antenna radiating element comprising by way of example three sections 100, 101, 102. These have sufficient total length to enable the antenna to resonate at the required operating frequency which in the case of operation in the GPS L1 frequency band is approximately 1575 MHz. At one end of the printed circuit board 109 there is preferably mounted a multipole connector 108 which provides a means of connection 111 between the end of the antenna conductor 100 and the underlying groundplane 107. In addition to providing the ground connection 111 for the antenna, the multipole connector 108 and socket 111 preferably provide connections for DC power, control and data connections to electronic circuits, including the radio circuit, housed in an RF-screened enclosure 106 which is attached to the copper cladding on the lower surface of the printed circuit board 109. The connector 108 and socket 111 are preferably demountable and provided with a detent to ensure that the module is securely attached once they have been engaged. An insulating support 112 is preferably provided at the end of the module remote from the connector 108 in order to provide additional mechanical stability; this support may be adhesively connected or connected by means of lugs or other attachment features to the printed circuit board 109 and the underlying groundplane 107. In an exemplary implementation the attachment to the printed circuit board 109 is by heat-deformable pins and to the groundplane 107 by double-sided adhesive tape.

A feed terminal point 104 is located on the opposite side of the slot 103 to the input to the receiving circuit contained in the screened housing 106 and is connected to the radio circuit by means of a conductor 105 which may enter enclosure 106 through a hole 110 or may be contained in an inner copper layer in a multilayer printed circuit board and be connected at both ends with conducting vias in the manner usual in printed circuit board design technique. The connection 105 may include capacitors and/or inductors may in order to provide additional impedance matching between the antenna and the input to the radio circuit.

The form of the radiating element 100, 101, 102 shown is by way of example. In other examples the conductor forming the element may be meandered or curved and may have additional notches or other features to modify its resonant frequency, feed impedance and bandwidth. Such forms of modification and the means of optimising them are well known to an engineer skilled in antenna design.

In some implementations the configuration of the radiating element 100, 101, 102 may provide for operation in more than one frequency band, for example GPS combined with several mobile radio frequency bands or those frequency bands used for wide area, local or personal networks. The specific design of such multiband antennas is well established in prior art. In such an embodiment the electronic circuits may contain separate or combined multiband transmitters and/or receivers.

The distance between the printed circuit board 109 and the groundplane 107 is preferably chosen to provide the required frequency bandwidth and antenna efficiency and is preferably chosen to suit the available dimensions of the connector and socket 108, 112 which may typically be between 3 mm and 6 mm.

The electronic circuits contained in the enclosure 106 may be chosen to suit the application of the antenna module. They may include, but are not limited to, matching circuits, filters, amplifiers, receivers, transmitters, sensors, microprocessors and associated memory modules.

While the configuration is preferably configured such that the antenna 100, 101, 102 lies on the upper surface of the printed circuit board 109 and the electronics module lies below it, proximate to the groundplane 107, this arrangement may be inverted such that the antenna lies below the printed circuit board and the module lies above it.

Circuit connections provided by the connector and socket 108, 112 may preferably include radio frequency conductors, for example connections to an external antenna which may be required if the location of the module does not provide adequate radio reception or transmission, for example if the module is located behind a car window which has a metallised anti-glare coating. The circuits within the enclosure 106 may optionally include an automatic switching circuit to detect and electrically connect such an external antenna if one has been mechanically connected to the external circuit.

It will be understood, with reference to the embodiment of FIGS. 5 and 6, that the radio circuit contained within the enclosure 106 is fed on one side by the connection 105, and on the other side by the multipole connector 108 and socket 111, neither of which connections are at zero impedance. In particular, the length of the connector 108 and the socket 111, which connect the radio circuit to the groundplane on the motherboard, provides a required distance from RF ground to provide the connection to the radio circuit with a non-zero impedance, and the connector 105, being connected to the antenna element 101 at feed terminal point 104, is even further from RF ground and thus also has non-zero impedance.

The invention claimed is:

1. A device comprising a radio circuit and a monopole antenna, wherein the radio circuit is disposed between two points on the monopole antenna, the two points having a predetermined relative impedance difference and neither of the two points being at a zero impedance with respect to ground;

wherein the monopole antenna has a first end connected to ground, the first end having a zero impedance with respect to ground;

wherein the monopole antenna has a second end, the second end having an infinite impedance with respect to ground; and wherein the radio circuit is connected to the two points on the monopole antenna, and the two points are located between the first and the second end, thus dividing the monopole antenna into three portions: a first portion between the first end of the monopole antenna and a first of the two points, a second portion between the second of the two points and the second end of the monopole, and a third portion between the two points.

2. A device as claimed in claim 1, wherein one end of the monopole antenna is configured for connection to ground, or is connected to ground.

3. A device as claimed in claim 2, wherein the one end of the monopole antenna is provided with a conductor connector having a predetermined length so as to provide a connection to ground at one end of the conductive connector while maintaining non-zero impedance at the other end of the conductive connector which is connected to one of the two points on the monopole antenna.

4. A device as claimed in claim 2, wherein the slot is substantially parallel-sided.

5. A device as claimed in claim 1, wherein the ground is a radio frequency ground and the two points have a relative impedance difference of substantially 50 ohms.

6. A device as claimed in claim 1, wherein the radio circuit comprises part of the monopole antenna.

7. A device as claimed in claim 1, further comprising a baseband processor or global positioning system (GPS) components.

8. A device as claimed in claim 1, wherein the monopole antenna is formed on one side of a multilayer board, and the radio circuit is located on an opposed side of the multilayer board.

9. A device as claimed in claim 1, further comprising an RF screened enclosure in which the radio circuit is contained.

10. A device as claimed in claim 9, wherein the RF screened enclosure is made of an electrically conductive material and forms part of the monopole antenna.

11. A device as claimed in claim 9, wherein the radio circuit is provided with a connection that passes through the RF screened enclosure and contacts one of the two points on the monopole antenna.

12. A device as claimed in claim 9, wherein the monopole antenna comprises at least first and second connected portions.

13. A device as claimed in claim 12, wherein the first and second portions each comprise a generally planar conductive area formed on a multilayer board the areas being arranged so as to define a slot there between.

14. A device as claimed in claim 12, wherein one of the two points is located on the first portion, and another of the two points is located on the second portion.

15. A device as claimed in claim 12, wherein the device is in combination with a motherboard having a ground plane, the monopole antenna being connected to the ground plane.

16. A device as claimed in claim 15, wherein the device is arranged substantially parallel to the motherboard.

17. A device as claimed in claim 16, wherein the device is spaced from the motherboard at a distance of between 1 and 10 mm.

18. A device as claimed in claim 16, wherein the radio circuit is located on a side of a multilayer board facing the motherboard.

19. A personal navigation device or a GPS receiver including a device as claimed in claim 16.

20. A device as claimed in claim 16, wherein the device is spaced from the motherboard at a distance of substantially 4.5 mm.

21. A device as claimed in claim 1, wherein one end of the radio circuit is connected to one of the two points on the monopole antenna and another end of the radio circuit is connected to another of the two points on the monopole.

22. A device as claimed in claim 1, wherein a first end of the monopole antenna is at zero impedance with respect to ground, a second end of the monopole antenna is at infinite impedance with respect to ground, and neither of the two points is at ground.

23. The device of claim 1 wherein the radio circuit is connected to the two points on the monopole antenna.

24. A device comprising:

a radio circuit; and a monopole antenna including two points, the radio circuit being disposed between the two points, thus dividing the monopole antenna into three portions, a first portion between a first of the two points and an end of the monopole antenna at infinite impedance, a second portion between the second of the two points and another end of the monopole antenna at ground, and a third portion between the two points and having a predetermined impedance difference, neither of the two points being at a zero impedance with respect to ground.

25. A device comprising:

a monopole antenna including a monopole antenna radiating element; and a radio circuit, wherein the radio circuit is connected between two points on the monopole antenna radiating element such that the radio circuit forms part of the monopole antenna, the two points dividing the monopole antenna into three portions, a first portion between a first of the two points and an end of the monopole antenna at infinite impedance, a second portion between the second of the two points and another end of the monopole antenna at ground, and a third portion between the two points, wherein the two points have a predetermined non-zero relative impedance difference and neither of the two points is at a zero impedance with respect to ground.

26. The device of claim 25 wherein the two points being located along length of the monopole antenna.

* * * * *